US005934876A

United States Patent [19]

Nagy

[11] Patent Number: 5,934,876

[45] Date of Patent: Aug. 10, 1999

[54] BLOWER WHEEL ASSEMBLY WITH STEEL HUB HAVING COLD-HEADED LUGS, AND METHOD OF MAKING SAME

[75] Inventor: Gregory R. Nagy, Elyria, Ohio

[73] Assignee: Beckett Air Incorporated, North Ridgeville, Ohio

[21] Appl. No.: 08/954,937

[22] Filed: Oct. 21, 1997

[51] Int. Cl.[6] ..... B63H 1/26

[52] U.S. Cl. ..... 416/178; 416/187; 416/204 R; 416/244 R

[58] Field of Search ..... 416/178, 187, 416/204 R, 244 R; 403/279, 280, 281

[56] References Cited

U.S. PATENT DOCUMENTS

| | | | |
|---|---|---|---|
| 1,069,854 | 8/1913 | Chisholm et al. . | |
| 1,410,093 | 3/1922 | Dallmeyer et al. . | |
| 1,657,758 | 1/1928 | Lum . | |
| 2,125,697 | 8/1938 | Swingle et al. . | |
| 2,242,586 | 5/1941 | Marbach . | |
| 2,291,480 | 7/1942 | Marbach . | |
| 2,473,185 | 6/1949 | Weiss . | |
| 2,496,179 | 1/1950 | Schwarz . | |
| 2,628,419 | 2/1953 | Wilken | 416/178 |
| 2,684,521 | 7/1954 | Morrison, Jr. . | |
| 2,724,547 | 11/1955 | Abbott et al. . | |
| 3,156,408 | 11/1964 | Whitenack, Jr. . | |
| 3,165,258 | 1/1965 | Wentling et al. . | |
| 3,221,398 | 12/1965 | Mayne . | |
| 3,253,318 | 5/1966 | Wentling et al. . | |
| 3,262,637 | 7/1966 | Sprouse et al. . | |
| 3,355,930 | 12/1967 | Fedorov . | |
| 3,385,511 | 5/1968 | Wentling . | |
| 3,567,335 | 3/1971 | David et al. . | |
| 3,608,174 | 9/1971 | Baker . | |
| 3,711,914 | 1/1973 | Baker . | |
| 3,750,442 | 8/1973 | Cogan . | |
| 3,816,023 | 6/1974 | Shaver . | |
| 3,844,682 | 10/1974 | Morris . | |
| 3,854,844 | 12/1974 | Ranz . | |
| 4,015,461 | 4/1977 | Schober . | |
| 4,245,491 | 1/1981 | Kondo et al. . | |
| 4,254,540 | 3/1981 | Bilak . | |
| 4,315,357 | 2/1982 | Calvano . | |
| 4,329,118 | 5/1982 | Ranz . | |
| 4,580,431 | 4/1986 | Oku et al. . | |
| 5,174,025 | 12/1992 | Tasaki et al. . | |

*Primary Examiner*—F. Daniel Lopez
*Assistant Examiner*—Ninh Nguyen
*Attorney, Agent, or Firm*—Renner, Otto, Boisselle & Sklar, P.L.L.

[57] ABSTRACT

A blower wheel assembly and method is characterized by a steel hub with protruding lugs that mate with a corresponding array of holes in a backplate of the assembly. The lugs are riveted or otherwise deformed to upset the lug material, thereby permanently and securely attaching the hub to the backplate. The lugs are formed on the hub by a cold heading process whereby the hub is forcefully impacted by a heading punch or die which has recesses in it corresponding to the shape and configuration of the lugs. The impact causes the hub to deform, with the steel flowing into the recesses of the die, thus forming the lugs.

19 Claims, 6 Drawing Sheets

BLOWER WHEEL ASSEMBLY WITH STEEL HUB HAVING COLD-HEADED LUGS, AND METHOD OF MAKING SAME

TECHNICAL FIELD

The present invention relates to a blower wheel assembly and methods of manufacturing the same. In particular, the invention relates to a blower wheel assembly with a steel hub having cold-headed protrusions to securely attach the hub to a backplate of the blower wheel assembly.

BACKGROUND OF THE INVENTION

FIG. 1 shows a prior art centrifugal blower wheel assembly 10 which includes a backplate 12, a hub 14, and a plurality of blades 16. The hub 14 and the blades 16 are attached to the backplate 12, which is typically a separate part. The blades 16 are secured to a ring 17; alternatively, the blades may be formed as a single piece, known as a bladestrip. The assembly 10 is used by attaching it to a rotational mechanism (not shown) via the hub 14 by means of a shaft (not shown). Rotation of the shaft causes rotation of the hub 14, backplate 12 and blades 16, thereby providing air flow. The connection between the backplate 12 and the hub 14 therefore is required to transmit the rotational torque of the shaft.

The maximum torque the hub 14 can withstand before coming loose with respect to the backplate 12 is termed the holding torque. The holding torque is a function of the way in which the hub is attached to the backplate. In addition, the holding torque can decrease over time as use changes the strength of that attachment. If the holding torque is exceeded, the hub becomes loose and will spin independently of the backplate 12, resulting in a catastrophic failure of the blower wheel assembly.

FIGS. 2A–2C illustrate details of a prior art hub and backplate configuration. The hub 14 has a concentric rim or lip 1 8 protruding from a front surface 19 of the hub 14. The lip 18 is designed to be placed in a hole 20 of the backplate 12 as illustrated in FIG. 2C. The hub 14 has a back surface 22 through which a hole 24 extends in order to receive a shaft (not shown) or other member for rotation. A threaded set screw hole 26 is provided along a radius of the hub. A set screw (not shown) can be threaded in the hole 26 to allow for the assembly 10 to be fixed with respect to the shaft within the hole 24.

The hub 14 is attached to the backplate 12 by forcing back (via stamping, for example) the rim or lip 18 while the rim or lip 18 extends through the hole 20 of the backplate 12, thereby crimping the rim or lip 18 against the backplate 12 and holding the hub 14 thereto. In some circumstances, however, the holding torque for this type of arrangement is either insufficient or inconsistent, and therefore undesirable.

The backplate 12, the hub 14, and the blades 16 are all typically made of steel, which provides for high strength, low cost, and ease of manufacture.

An objective of the invention is to provide a blower wheel assembly with a hub that is more strongly attached to the backplate, that can be used over a wide range of temperatures, and that is inexpensive to manufacture.

SUMMARY OF THE INVENTION

The invention provides a blower wheel assembly and method characterized by a steel hub with protruding lugs that mate with a corresponding array of holes in a backplate of the assembly. The lugs are riveted or otherwise deformed to upset the lug material, thereby permanently and securely attaching the hub to the backplate. The lugs are formed on the hub by a cold heading process whereby the hub is forcefully impacted by a punch or die which has recesses in it corresponding to the shape and configuration of the lugs. The impact causes the hub to deform, with the steel flowing into the recesses of the die, thus forming the lugs.

Thus, according to one aspect of the invention, a blower wheel assembly has a backplate with an array of holes, a plurality of blades attached to the backplate, and a steel hub attached to the backplate. The steel hub has one or more lugs formed by a cold heading process and mated with respective holes in the backplate.

According to another aspect of the invention, a method of manufacturing a blower wheel assembly includes the steps of forming a steel hub having one or more cold-headed lugs, and attaching the hub to a backplate which has an array of holes corresponding to the lugs, the attaching including inserting the lugs in the array of holes and deforming the lugs to lock the hub in place.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 1:
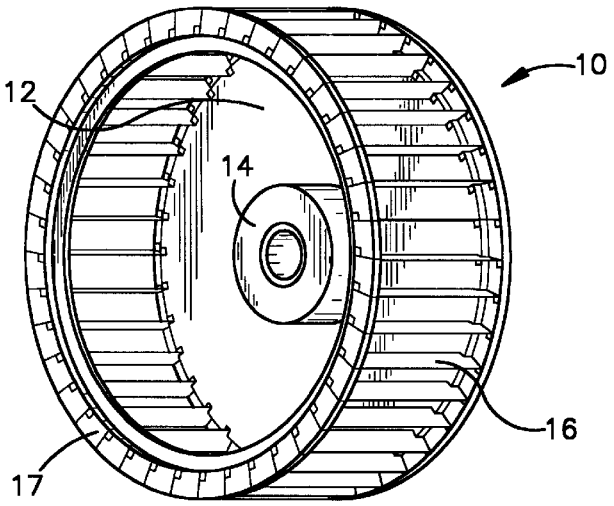
Fig.1 (PRIOR ART)
FIG. 1 is a perspective view of a prior art blower wheel assembly.
Figure 2A:
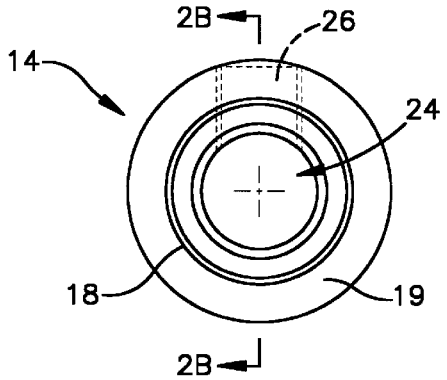
Fig.2A (PRIOR ART)
FIG. 2A is an end view of a prior art hub for a blower wheel assembly.
Figure 2C:
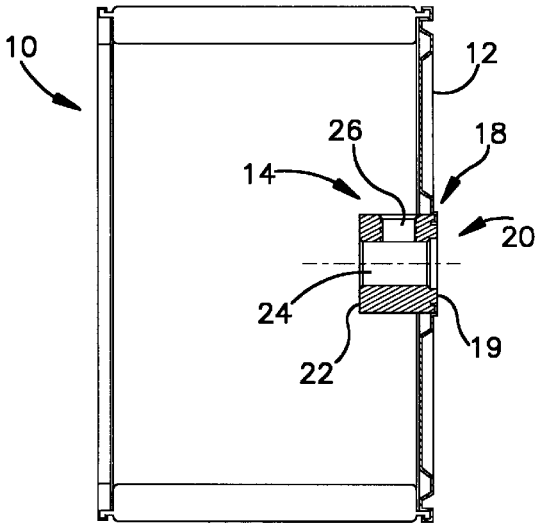
Fig.2C (PRIOR ART)
FIG. 2C is a sectional view showing the prior art hub attached to a backplate.
Figure 2B:
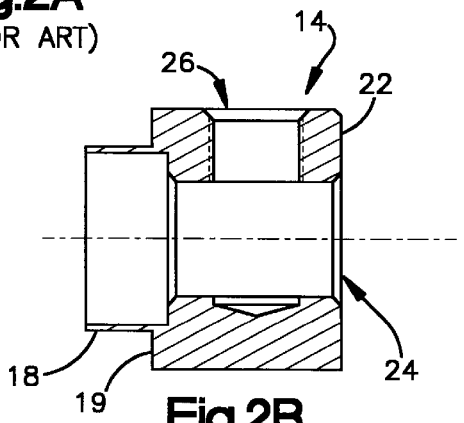
Fig.2B (PRIOR ART)
FIG. 2B is a sectional view along section A—A of FIG. 2A.
Figure 3A:
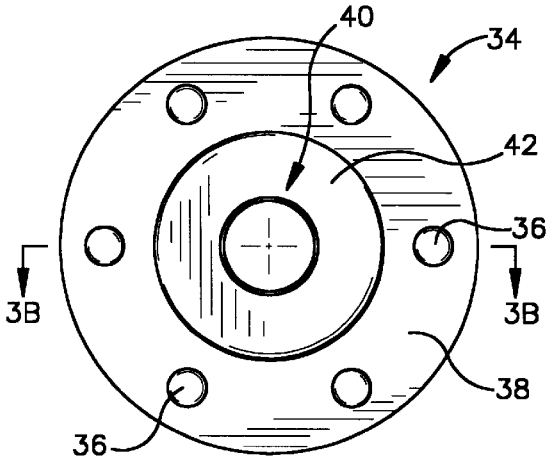
Fig.3A (PRIOR ART)
FIG. 3A is an end view of a prior art aluminum hub with protrusions.
Figure 3B:
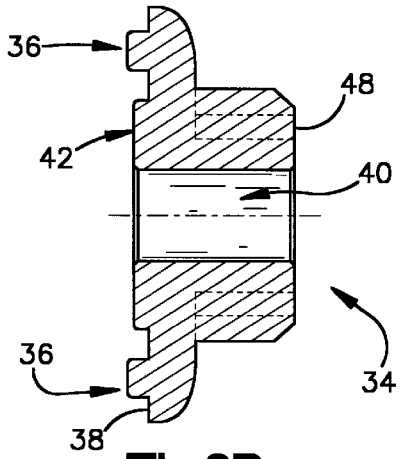
Fig.3B (PRIOR ART)
FIG. 3B is a sectional view of the prior art aluminum hub.
Figure 3C:
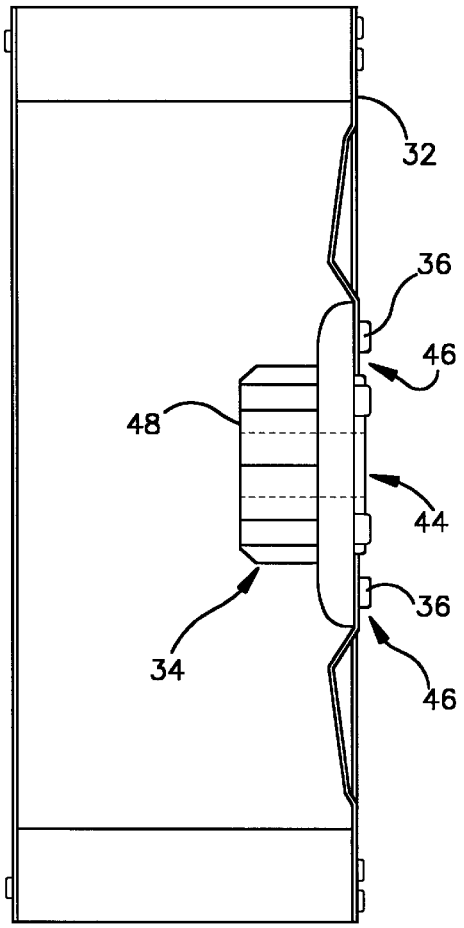
Fig.3C (PRIOR ART)
FIG. 3C is a side view of the prior art aluminum hub attached to a backplate.

FIGS. 3A–3C show a prior art aluminum hub 34 for accommodating a backplate 32. The prior art aluminum hub 34 has six radial protrusions 36 (also called lugs or pips) extending from a front surface 38 of the hub 34. The protrusions 36 are formed on the hub 34 by cold extrusion. A hole 40 extends through the hub 34 to receive a shaft for rotation (not shown), similar to the way in which the hole 24 extends through the hub 14 in the prior art blower wheel assembly of FIGS. 2A–2C. Besides the lugs 36 there is a central protrusion 42 extending from the front surface 38. The backplate 32 has a central hole 44 to receive the central protrusion 42 and an array of holes 46 for receiving the lugs 36.

The hub 34 is attached to the backplate 32 by first engaging the lugs 36 and the central protrusion 42 of the hub 34 in the corresponding holes 44 and 46 of the backplate 32. Then, while a back surface 48 of the hub 34 is held in place, the lugs 36 are struck with sufficient force to cause them to deform, flattening them such that they no longer can be pulled back through the holes 46. This securely attaches the hub 34 to the backplate 32. The engagement of the lugs 36 in the array of holes 46 of the backplate 32 provides for increased strength in the attachment of the aluminum hub 34 to the backplate 32 for a blower wheel assembly using this prior art design.

However, difficulties have been discovered in evaluating the prior art aluminum hub 34. Use of an aluminum hub involves a joining of dissimilar metals, since the backplate 32 is made of steel. Steel and aluminum have different coefficients of thermal expansion, so the hub 34 and the backplate 32 endure stresses at the attachment points when the blower wheel assembly undergoes a change of temperature. This difference in coefficients of thermal expansion is particularly a problem when the blower wheel assembly is to be used in an environment subjected to wide swings of temperature, such as in a furnace or air conditioner. In such applications it is common for the blower wheel assembly to be subjected to changes from ambient temperature to 450° F. within one minute. Because the shaft which extends through the hole 40 is made of steel, thermal gradient cycling results in a long term reliability problem of the hub coming loose with respect to the shaft. Additionally, because the set screw is made of steel, thermal gradient cycling leads to loosening of the set screw, thereby causing the shaft to rotate independently of the hub and the rest of the blower wheel assembly.

Joining of the dissimilar metals aluminum and steel can also lead to galvanic corrosion in the hub.

Further, the relative malleability of aluminum when compared to steel results in difficulties in securing the shaft by use of the set screw mating with the threaded hole in the hub. Since the steel set screw is harder than the aluminum hub, the screw can strip the threads of the hole unless care is taken to avoid overtightening. The above-mentioned difficulties all but rule out use of blower wheel assemblies with aluminum hubs for applications with large thermal gradients.

Consequently, the prior art aluminum hub 34 is undesirable in blower wheel assemblies.

Despite the difficulties inherent in the prior art aluminum hub 34, the malleability of aluminum has the advantage of being relatively easy to manufacture into a desired shape. In contrast, a steel hub with lugs is relatively difficult to manufacture. Several possible methods of manufacturing a steel hub with lugs turn out to be undesirable: machining, die casting, and using a powdered metal process.

Figure 4A:
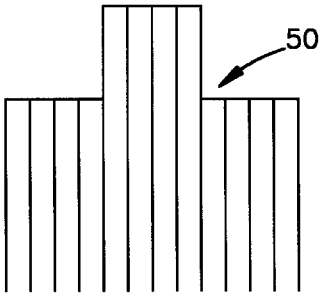
FIG. 4A is a side view showing the metal grains in the vicinity of a protrusion formed by machining.

Machining is undesirable in that it is relatively expensive and time-consuming when compared to other methods. Further, manufacturing steel hubs with lugs by machining introduces structural weaknesses in the vicinity of the lugs. As illustrated in FIG. 4A, machining involves removing material, leaving the metal grains straight, breaking the grain flow and thereby creating a weakness at a junction 50 where a lug would be joined to the rest of the hub. Consequently, a machining process results in lugs that are prone to breakage.

Die-casting suffers from expensive tooling costs. In addition, the material that can be die cast is limited to zinc, aluminum, magnesium, and copper alloys. Die cast zinc is weaker than steel. Tooling wear is greater with die casting and piece price is higher than with steel, partly due to secondary operations such as sprue trimming and tumbling that would be necessary. Porosity may be an issue due to air entrapment in the mold cavity, resulting in a weaker part.

Powdered metal processes have the disadvantage that the metal produced is porous. This leads the lugs to have structural weaknesses at the preferred height/width ratio, making the lugs fragile and difficult to manufacture. These problems with manufacturability would result in a high rejection rate of hubs made by powdered metal processes. The problems can be alleviated to some extent by adding a second material (e.g., copper) to fill the gaps in the steel structure. However, this addition of a second material increases costs.

Figure 4B:
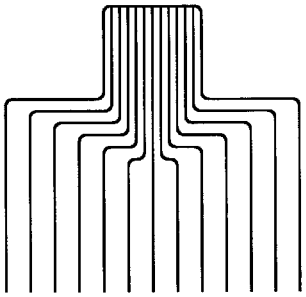
FIG. 4B is a side view showing the metal grains in the vicinity of a protrusion formed by cold heading.

By contrast, it has been found that making lugs on a steel hub 54 by a cold-heading process (also known as cold upsetting or cold forging) provides cost and performance advantages over other methods of manufacture. Cold-heading does not require expensive tooling. In addition, the steel hub of an exemplary design may be manufactured in a cycle time of approximately two seconds by cold heading, as opposed to the approximately ten seconds required to machine a hub of similar dimensions. Further, the cold-headed process provides increased durability over both the powdered metal process (for substantial height/width ratios) and the machined process. As seen in FIG. 4B, the metal grains are continuous in the hub where the lugs are cold-headed, following the outline of the hub and therefore providing greater strength than those of a machined hub.

Figure 5A:
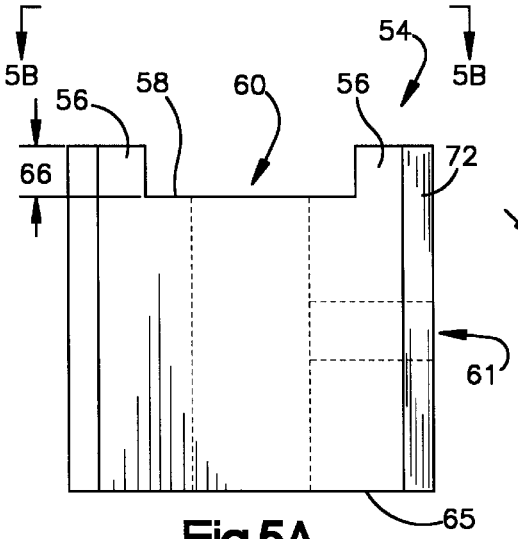
FIG. 5A is a side view of a hub of the present invention.
Figure 5B:
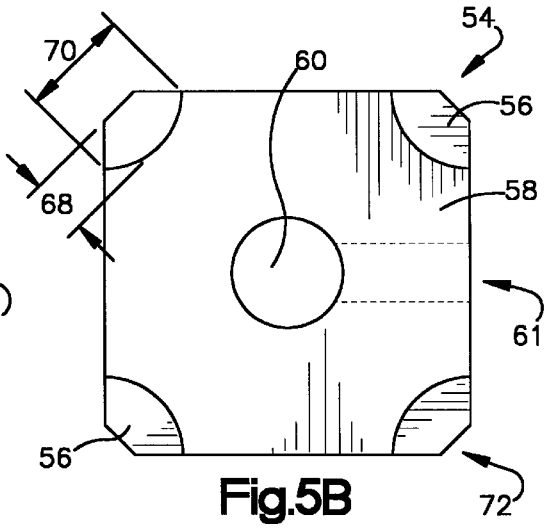
FIG. 5B is a plan view of the hub of FIG. 5A.
Figure 5C:
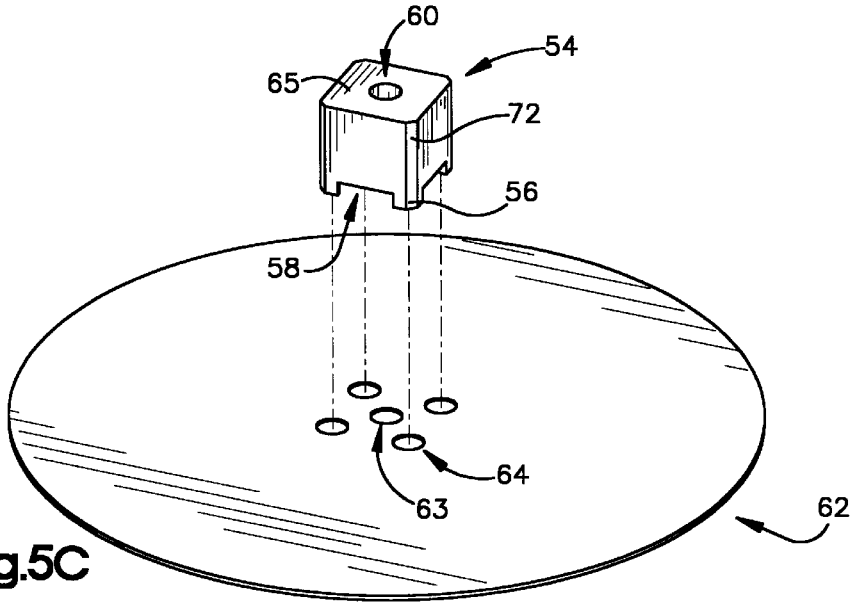
FIG. 5C is an exploded perspective view of a blower wheel assembly of the present invention.

The steel hub 54 in accordance with the present invention is shown in FIGS. 5A–5C. It has a plurality of lugs 56 extending from a front surface 58. In a manner similar to the prior art hubs, the hub 54 has a hole 60 extending therethrough to receive and engage a shaft (not shown). A threaded hole 61 is also provided for a set screw (not shown) that can fix the shaft to the blower assembly. The hub 54 is affixed to a backplate 62, as illustrated in FIG. 5C, which is similar in design to the backplate 32 in that the backplate 62 has a central hole 63 for accommodating the shaft and an array of holes 64 for mating with the lugs 56.

The assembly method for fixing the hub 54 to the backplate 62 involves first engaging the lugs 56 with the corresponding holes 64 of the backplate 62. Then, while a back surface 65 of the hub 54 is held in place, the lugs 56 are struck with sufficient force to cause them to deform such that they no longer fit through the holes 64 of the backplate 62. The process of striking the lugs 56 is termed "impacting", "riveting", or "upsetting", depending on the method of the striking.

Four lugs 56 are shown in the preferred embodiment illustrated in FIGS. 5A and 5B, although a greater or lesser number of lugs 56 may be used. A hub with four lugs 56, however, is preferred because of its relative symmetry and because it has been found to provide sufficient attachment strength for the blower wheel assembly. The use of fewer lugs than the prior art aluminum hub 34 provides the advantage of reduced cost of manufacture.

The lugs 56 may be formed into a variety of shapes. Cylindrical lugs, such as the lugs 36 employed in the prior art hub 34 (FIG. 2B) may be employed. Noncylindrical lugs, however, such as those shown in FIGS. 5A and 5B, have been found to be satisfactory. The lugs 56 have a height 66 which is approximately equal to their width 68 in the radial direction. The ratio of the width 68 to the height 66 may be in a broad range which is dependent on the characteristics of the material being worked. An exemplary range would be approximately 0.5:1 to approximately 2:1, with the ratio being prefereably greater than approximately 0.8:1. However, a ratio that is too small can result in lugs that are prone to breaking off, thereby making the hub 54 more difficult to manufacture. The lugs 56 have a length 70 in a radial direction that is preferably approximately twice the width 68 of the lugs. This increased thickness in the radial direction provides greater strength in the direction of hub rotation and thus results in increased strength against radial stresses between the hub 54 and the backplate 62. The lugs 56 having a shape such as that shown in FIGS. 5A and 5B will preferably be used with backplate holes 64 that are elliptical or slotted, but holes that are round or have other shapes may be used as well.

The hub 54 preferably has a basically square cross-section with flattened corners 72. It will be appreciated, however, that the hub 54 may have a round or other shaped cross-section. A hub of any shape having one or more cold-headed protrusions for engaging a backplate is contemplated as falling within the scope of the present invention.

Figure 6:
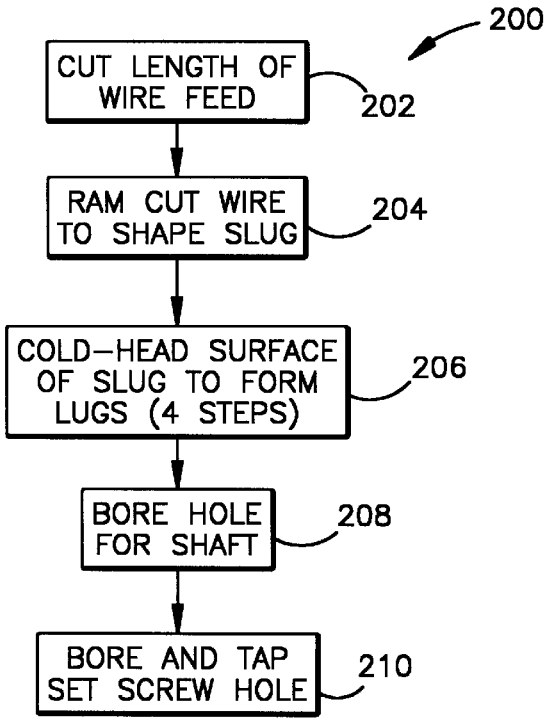
FIG. 6 is a flow chart showing the steps in the preferred method of manufacturing the hub of the present invention.

The method 200 of manufacturing of the steel hub 54 is illustrated in FIG. 6 and begins with cutting a length of steel wire at step 202 to a desired length. The hub 54 preferably is formed according to the disclosed method from lengths of 0.875" diameter steel wire, although the method is by no means limited as to the size or cross-sectional shape of the steel wire. The length of steel wire is then rammed (impacted with a shaping punch having a recess of a given shape) to form the wire into a slug having a desired cross-sectional shape, at step 204.

Figure 7:
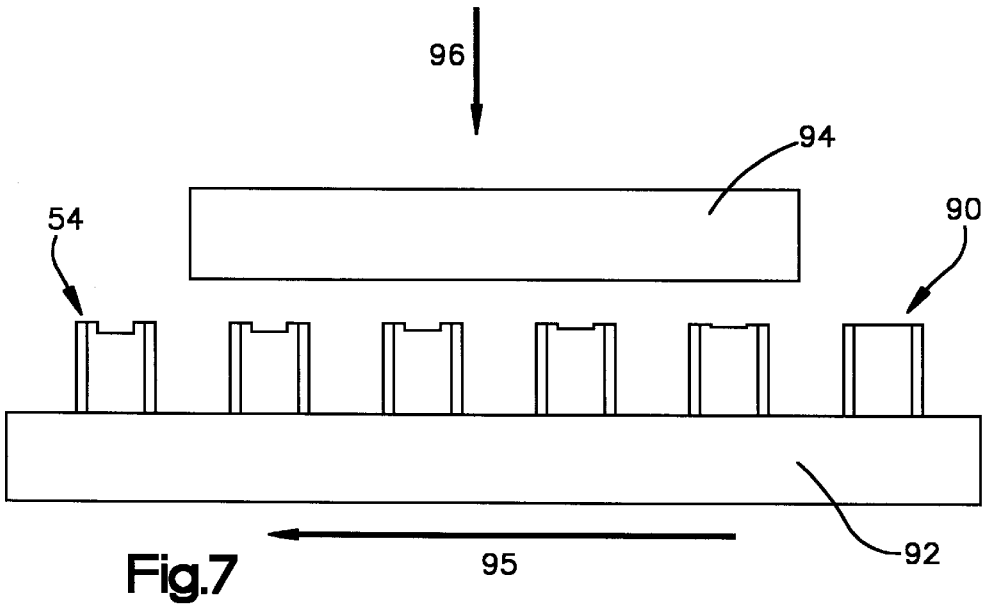
FIG. 7 is a side view showing a cold-heading process.

After ramming, the slug is then cold-headed to form the lugs 56 on the front surface 58, at step 206. This cold-heading process, illustrated in FIG. 7, consists of four substeps. A typical slug 90 is secured in a container or tray 92 which moves the slug 90 relative to a heading punch 94 in a direction 95. The front surface 58 of the slug 90 faces the punch 94. The punch 94 has an array of recesses (not shown) at four locations in the direction 95, the recesses at each of the locations corresponding to the shape of the slug 90 and the positions where the lugs 56 are to be formed. As the slug 90 reaches each of the locations in the direction 95, the container or tray 92 is stopped, and the punch 94 is engaged with great force in a direction 96 parallel to the axis of the slug 90. The resulting impact between the punch 94 and the slug 90 causes the steel of the slug 90 to be compressed with such force that the metal of the slug 90 flows into the recesses of the punch 94, thereby forming the lugs 56. The punch 94 is preferably designed to impact four slugs simultaneously, with four impacts on a single slug 90 needed to form the lugs 56 of the hub 54. However, the punch 94 may alternatively be designed to impact a greater or lesser number of slugs, with the impacting of multiple slugs not necessarily being simultaneous. In addition, cold-heading processes may be designed to be accomplished in greater than or less than four impacts.

After the cold-heading step 206, the method 200 of manufacturing the hub 54 includes boring the hole 60 for the shaft at step 208, and boring and tapping the set screw hole 61 at step 210.

Figure 8A:
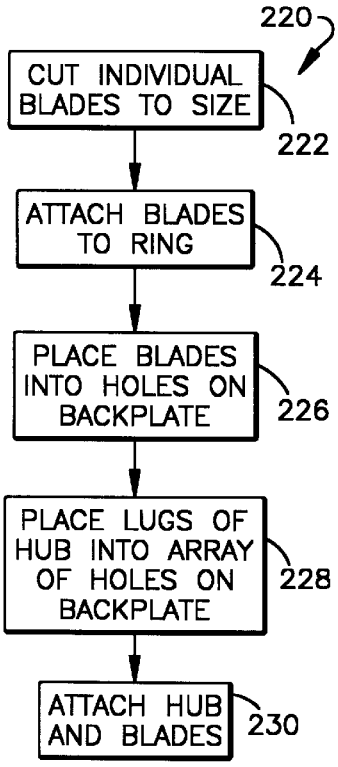
FIG. 8A is a flow chart showing the steps of a method of assembling a blower wheel assembly according to the present invention.
Figure 8B:
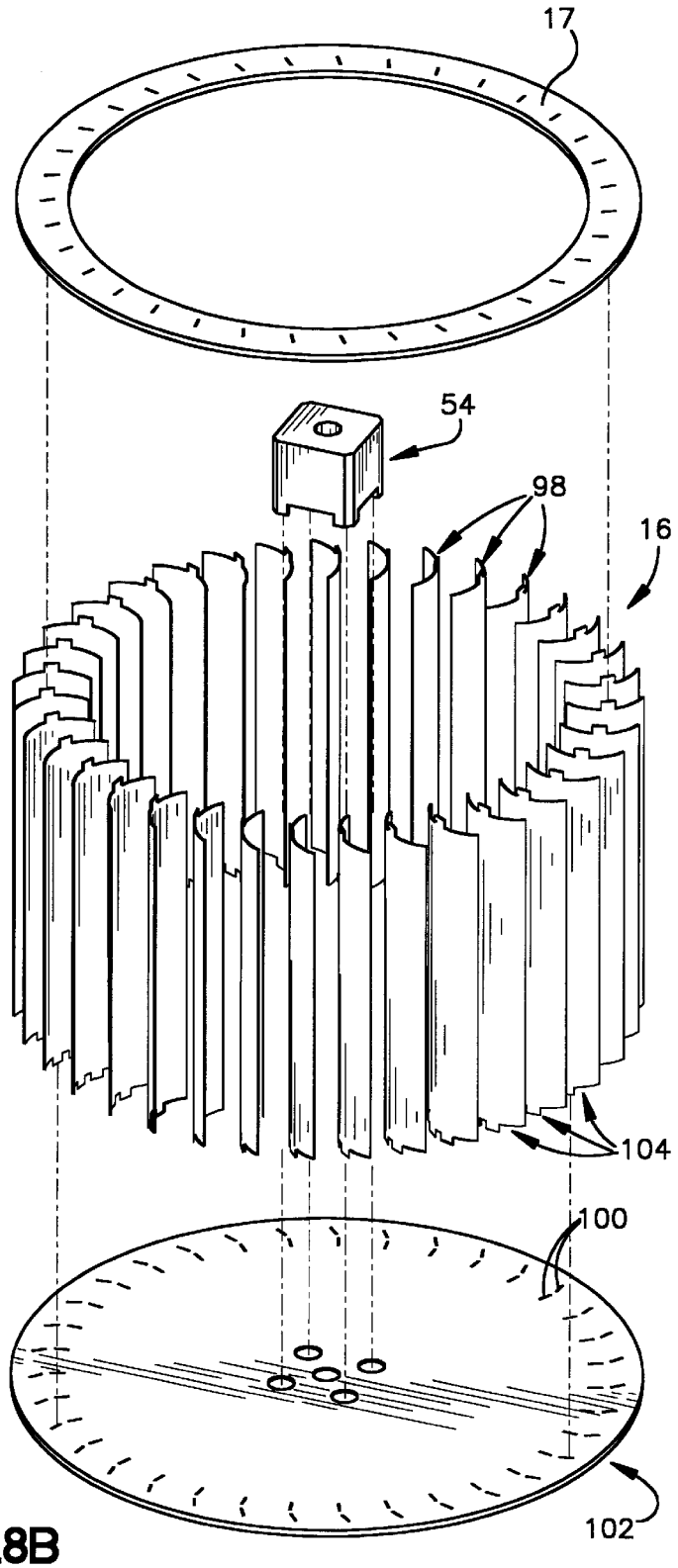
FIG. 8B is an exploded perspective view of the parts of the blower wheel assembly which are assembled by the method of FIG. 8A.

Turning to FIGS. 8A and 8B, a method 220 of manufacturing a blower wheel assembly of the present invention is shown. The initially individual blades 16 are cut to size at step 222. Then one end 98 of each of the blades 16 is attached to the ring 17 at step 224. The other ends 104 of the blades 16 are placed in holes or slots 100 in a backplate 102 at step 226. After the lugs 56 of the hub 54 are inserted in the array of holes 46 near the center of the backplate 102 at step 228, the hub 54 and blades 16 are preferably attached in a single step 230 of riveting the lugs 56 (deforming the lugs by impacting with high-frequency hammers) and riveting or bending the protruding ends 104 of the blades 16. An example of a method of attaching individual blades of a blower wheel assembly through holes in a backplate is provided in U.S. Pat. No. 3,262,637, entitled INDIVIDUAL BLADE MOUNTINGS IN A BLOWER WHEEL, which is incorporated in its entirety herein by reference. Alternatively, the lugs 56 of the hub 54 may be attached to the backplate 102 by staking.

Figure 9A:
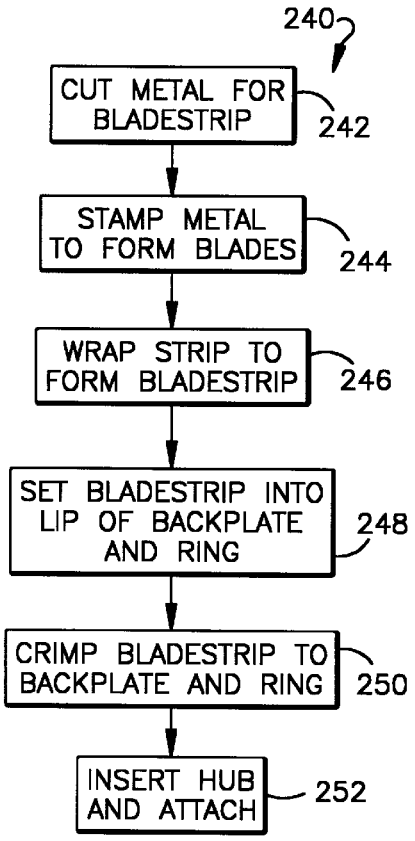
FIG. 9A is a flow chart showing the steps of an alternative method of assembling a blower wheel assembly according to the present invention.
Figure 9B:
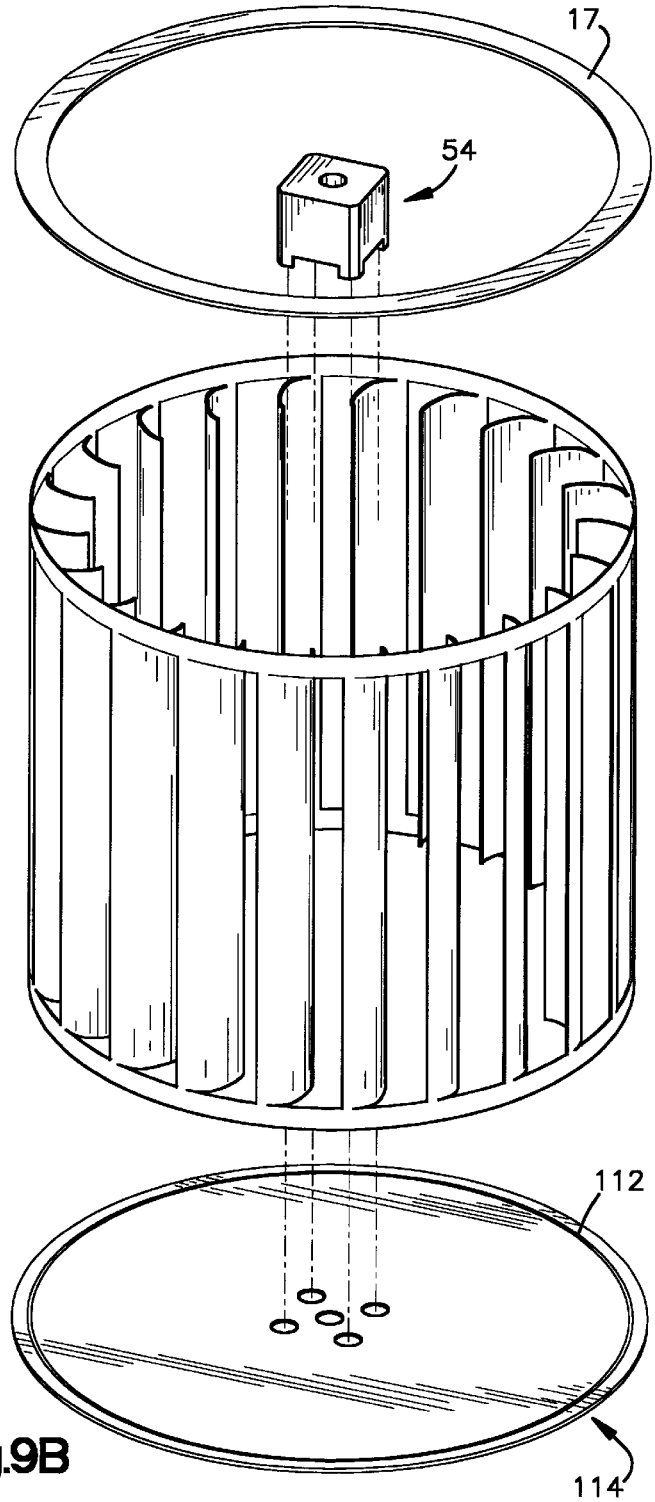
FIG. 9B is an exploded perspective view of the parts of the blower wheel assembly which are assembled by the method of FIG. 9A.

Another method 240 of manufacturing a blower wheel assembly according to the present invention is shown in FIGS. 9A and 9B. Initially a strip is cut from sheet metal at step 242, the strip of metal (not shown) is stamped at step 244 to form blades, and then the strip is wrapped at step 246 to form a cylindrical bladestrip 110. This method of forming a plurality of blades for a blower assembly as a single piece is demonstrated in U.S. Pat. No. 2,242,586, entitled METHOD OF MAKING BLOWERS, and in U.S. Pat. No. 3,711,914, entitled METHOD FOR ASSEMBLING CENTRIFUGAL BLOWERS, both of which are incorporated in their entireties herein by reference. The bladestrip 110 is then placed in an annular depression 112 near the perimeter of a backplate 114 and a ring 17 placed atop the bladestrip 114, at step 248. Thereafter, the bladestrip 110 is attached to the backplate 114 and the ring 17 by crimping at step 250. An example of a crimped bladestrip is shown in FIG. 2C. After the bladestrip 110 is attached to the backplate 114, the lugs 56 of the hub 54 are placed in the array of holes 46 in the backplate 114, and the hub 54 is attached to the backplate 114 by riveting, upsetting or otherwise deforming the lugs 56 at step 252.

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A blower wheel assembly comprising:

a backplate with an array of holes therein;

a plurality of blades attached to the backplate; and a steel hub attached to the backplate, the steel hub having one or more lugs corresponding to the array of holes, the lugs being formed by a cold heading process.

2. The blower wheel assembly of claim 1, wherein the steel hub is attached to the backplate by the one or more lugs being deformed.

3. The blower wheel assembly of claim 2, wherein the steel hub has a hole for mounting to a shaft.

4. The blower wheel assembly of claim 3, wherein the lugs are distributed substantially symmetrically about the hole.

5. The blower wheel assembly of claim 4, wherein the hole has an axis and the lugs have a height in the direction of the axis and a width in a direction perpendicular to the axis, the ratio of the width to the height being in the range of approximately 0.5:1 to approximately 2:1.

6. The blower wheel assembly of claim 5, wherein the ratio is greater than approximately 0.8:1.

7. The blower wheel assembly of claim 6, wherein the height and the width are approximately equal.

8. The blower wheel assembly of claim 1, wherein each of the holes of the array of holes has a substantially elliptical shape.

9. The blower wheel assembly of claim 1, wherein there are no more than four lugs.

10. A method of manufacturing a blower wheel assembly comprising the steps of:

forming a steel hub having one or more cold-headed lugs; and attaching the steel hub to a backplate which has an array of holes corresponding to the one or more lugs, the attaching including:

inserting the lugs in the array of holes; and deforming the lugs to lock the hub in place.

11. The method of claim 10, wherein the forming of the steel hub comprises the substeps of:

cutting a length of steel wire to form a slug;

impacting the slug with a heading punch having a plurality of indentations, thereby forming the one or more lugs.

12. The method of claim 11, the forming of the steel hub comprising the additional step, prior to impacting, of shaping the slug by impacting it with a shaping punch.

13. The method of claim 12, wherein the forming of the one or more lugs is accomplished by multiple impacts of the heading punch.

14. The method of claim 13, wherein the forming of the steel hub further comprises boring a hole in the hub, drilling a set screw hole through the hub, and tapping the set screw hole.

15. The method of claim 11, wherein the steel wire has a substantially circular cross section.

16. The method of claim 10, further comprising the step of attaching a plurality of blades to the backplate.

17. The method of claim 16, wherein the plurality of blades is formed as a single unit by being punched out of sheet metal.

18. The method of claim 16, wherein the attaching of the plurality of blades and the steel hub to the backplate are accomplished simultaneously.

19. The method of claim 18, further comprising attaching a ring to the plurality of blades.

* * * * *